US005855168A

United States Patent [19]

Nikam

[11] Patent Number: 5,855,168

[45] Date of Patent: Jan. 5, 1999

[54] SUGAR CANE MILLING SYSTEM

[76] Inventor: Bhausaheb Bapurao Nikam, 304, Punit Apartments, 526, Narayan Peth, Pune Maharashtra, India, 411030

[21] Appl. No.: 732,074

[22] Filed: Oct. 16, 1996

[30] Foreign Application Priority Data

May 28, 1996 [LK] Sri Lanka ..... 10993

[51] Int. Cl.[6] ..... B30B 9/20

[52] U.S. Cl. ..... 100/121; 100/110; 100/139; 100/162 R; 100/173; 100/174

[58] Field of Search ..... 100/72–75, 110, 100/121, 130, 139, 145, 146, 161–167, 174, 173; 492/36; 127/2–6, 43

[56] References Cited

U.S. PATENT DOCUMENTS

| | | | |
|---|---|---|---|
| 304,813 | 9/1884 | Fehrenbatch | 100/75 |
| 485,837 | 11/1892 | Brown | 100/166 |
| 1,346,594 | 7/1920 | Deerr | 100/174 |
| 1,644,607 | 10/1927 | Perez | 100/174 |
| 1,763,855 | 6/1930 | Maxwell | 100/162 R |
| 3,086,452 | 4/1963 | French | 100/75 |
| 3,113,507 | 12/1963 | Riviere | 100/75 |
| 3,472,160 | 10/1969 | Scott | 100/176 |
| 3,536,002 | 10/1970 | Miller | 100/173 |
| 3,827,909 | 8/1974 | Farmer | 100/139 |
| 3,969,802 | 7/1976 | Bouvet | 100/121 |
| 4,147,557 | 4/1979 | Mayo | 100/173 |
| 4,168,660 | 9/1979 | Zelle | 100/162 R |
| 4,310,361 | 1/1982 | Georget | 100/163 A |
| 4,589,923 | 5/1986 | Gruenwald | 100/121 |
| 4,989,305 | 2/1991 | Pole et al. | 100/121 |
| 5,273,512 | 12/1993 | Ducasse | 100/121 |

FOREIGN PATENT DOCUMENTS

| | | | |
|---|---|---|---|
| 60-106698 | 6/1985 | Japan | 100/121 |
| 638871 | 6/1950 | United Kingdom | 100/161 |

*Primary Examiner*—Stephen F. Gerrity
*Attorney, Agent, or Firm*—Harrison & Egbert

[57] ABSTRACT

A sugar cane milling system for two roll or three roll crushing mill modules in tandem in which one or more of these mill modules is provided in addition and adjacent to it with at least one toothed feeder roller and with a juice drainer in the form of a scraper-cum-short deflector for feeding a compact mat of prepared cane/bagasse directly to the nip of the crushing rolls of the modules. The prepared cane mat is fed approximately at the same speed as the surface speed of the crushing mill rolls without sharp changes in direction. Superficial juice is separated out as the cane mat is fed. A pressurized juice extracting conveyor is provided for removing the extra unabsorbed juice as well as squeezing out the absorbed juice out of cush-cush.

8 Claims, 3 Drawing Sheets

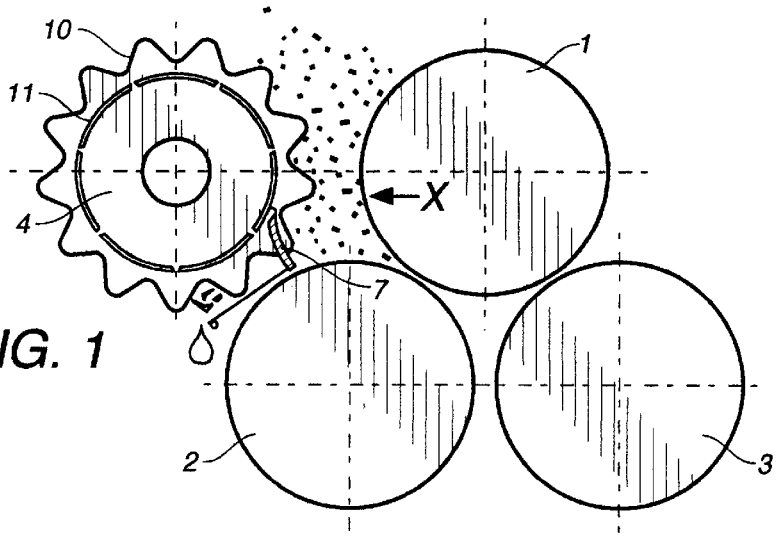
FIG. 1
FIG. 3
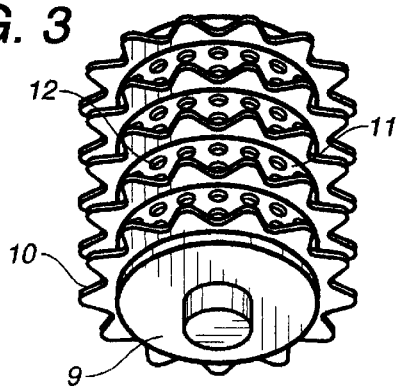
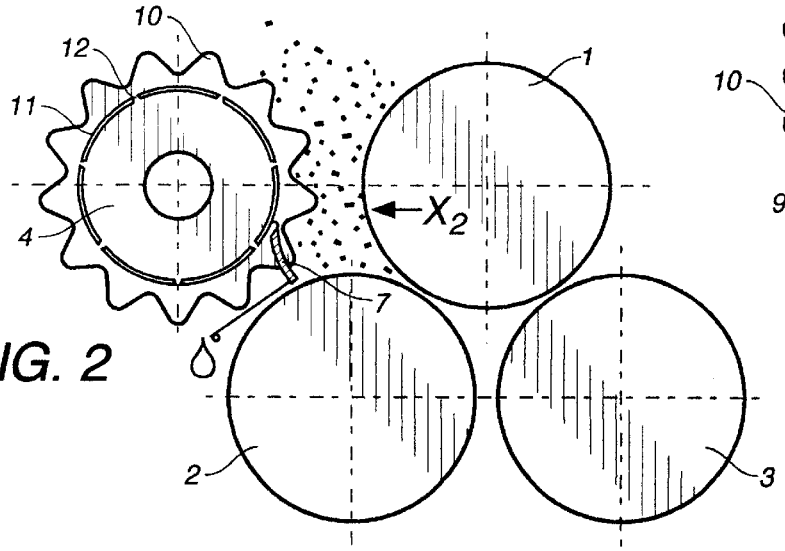
FIG. 2

FIG. 10
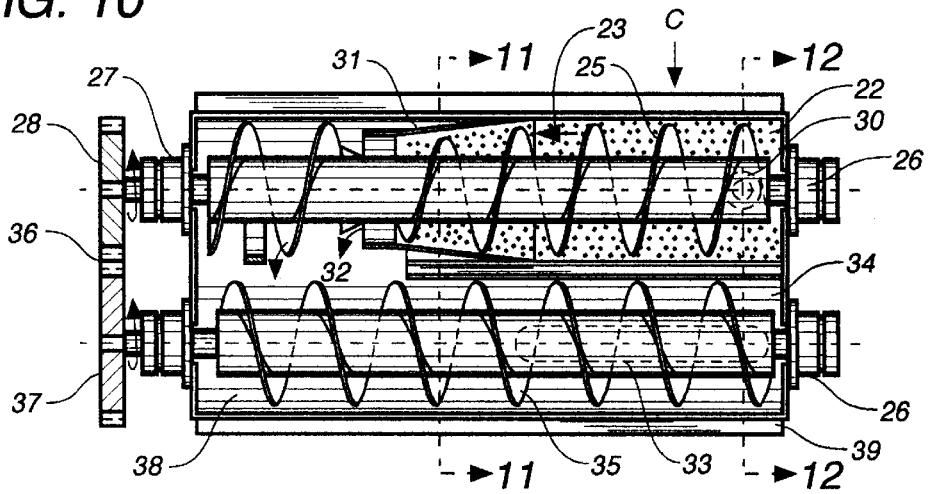
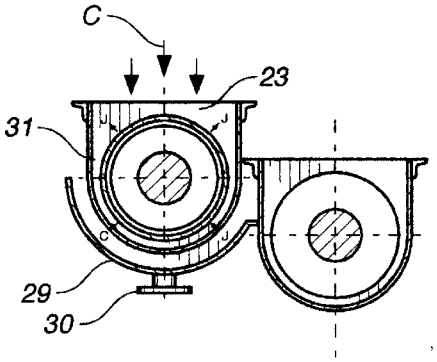
FIG. 11
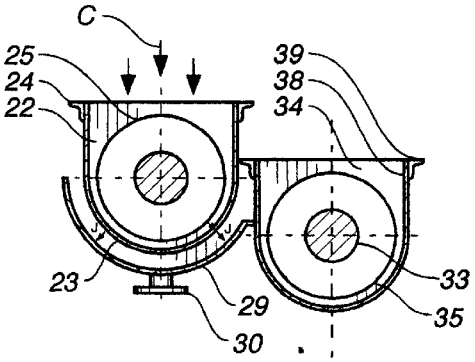
FIG. 12
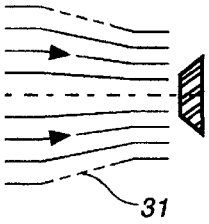
FIG. 13
FIG. 14
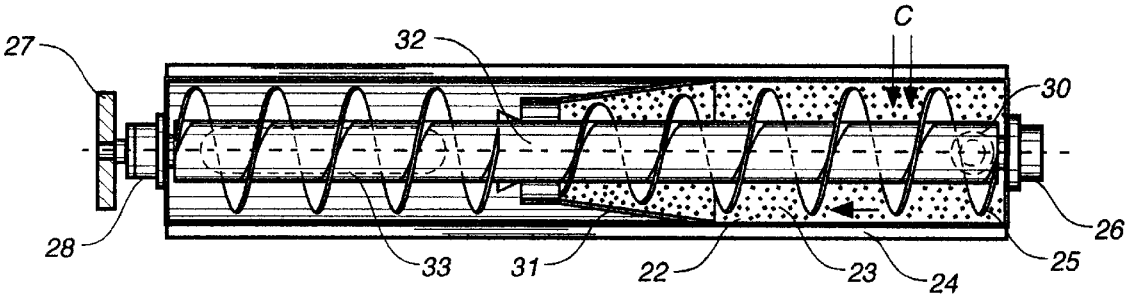

SUGAR CANE MILLING SYSTEM

FIELD OF INVENTION

The present invention relates to improvements in sugar cane milling system having at least one toothed feeder roller with juice drainage means for increasing the feedability of prepared cane/bagasse in order to increase the cane crushing capacity and juice extraction efficiency of the mill with reduced power consumption and moisture of the bagasse.

BACKGROUND OF THE INVENTION

In the prior art, a sugar cane crushing mill comprises a two roll mill module consisting of a top roll and a feed roll or a three roll mill module consisting of a top roll, a feed roll and a discharge roll. These rolls are made of cast iron or cast steel and are provided with peripheral grooves. A plurality of these main crushing mill modules are provided in tandem forming the cane crushing mill.

The main drawbacks of these cane crushing mills are:

1. The bulk density of the prepared cane/bagasse being fed to the mills is very low. This results into a very low cane crushing rate of the mill.
2. There is a slippage between the cane/bagasse and rolls resulting in higher frictional losses and thus, besides low cane crushing rate, power consumption is more.
3. Feed to discharge operating opening ratio is higher due to low bulk density and slippage of cane/bagasse. This causes lower juice extraction and higher juice reabsorption. As used herein, feed to discharge operating opening ratio means the ratio of the gap between top roll and feed roll to the gap between top roll and discharge roll in operating position of the mill, i.e. in lifted/shifted position of the rolls against the hydraulic pressure.

In the prior art, to increase the bulk density of the cane/bagasse, feeding equipment in the form of over/under feeder rollers provided above or below the prepared cane mat, being fed through a conveyer and/or Donnelly chute, are incorporated with the crushing mill module. The over or under feeder roller has peripheral grooves or axial or helical ribs.

This feeding equipment is not able to provide any significant relief to the drawbacks of the prior art cane crushing mill, described hereinbefore, due to its inherent limitations of developing pressure.

Further, in the prior art, a pair of grooved feeder rollers or a pair of toothed feeder rollers are incorporated in front of the feed and top rolls of the main crushing mill module, nearly in a parallel plane and in-line, i.e. having approximately the same central axis. A closed stationary diverging pressure chute, having a wider opening towards the main mill rolls, is required to be connected between the pair of feeder rollers and the main crushing mill rolls.

The main drawback of this arrangement is that the speed of the cane in comparison with the mill rolls surface speed is very low. This results in more frictional losses, more wear and tear and choking in the cane feeding system. As a result of this undue pressure leads to damage of various parts and hence there is frequent breakdown of the mill, resulting into low milling capacity, high power consumption and maintenance cost. Additionally, skilled personnel are required for maintenance and operation of these mills.

Furthermore, in the prior art sugar cane crushing mills, the cush-cush soaked with juice in the strainer is fed into the mill module, under the strainer, for milling along with the bagasse. The main drawback of this system is that the high purity of the juice in the cush-cush is recirculated through the mill module. This creates extra slippage, juice overloading and poor juice drainage and results in lower capacity and efficiency of milling.

SUMMARY OF THE INVENTION

It is therefore a primary object of this invention to provide a new and improved sugar cane milling system in which the bulk density of the cane/bagasse mat is increased and feed to discharge operating opening ratio is decreased by providing at least one toothed feeder roller with juice drainage means in addition to and adjacent to two/three roll mill modules. This will result in increased cane feedability, i.e. increased cane crushing capacity of a mill, along with higher juice extraction efficiency and lower power consumption.

Another object of this invention is to provide an improved sugar cane milling system in which the compacted cane/bagasse is fed directly to the main crushing mill rolls, almost at the same speed as the surface speed of mill rolls and without sharp changes in direction and without needing the enclosed stationary pressure chute. There is no choking and overloading. This results in almost negligible wear and tear of the parts and thus very low maintenance and breakdowns. It also gives a high average output. The construction of the mill is also simplified.

A further object of this invention is to provide an improved sugar cane milling system in which an improved cush-cush juice extracting conveyer is provided which not only separates the extra juice from the cush-cush but most of the absorbed juice is also extracted and separated out from the cush-cush being fed to the mill module. As a result, the present invention provides reduced slippage, reabsorption and juice overloading on the mill, resulting into higher juice extraction efficiency and higher capacity of milling.

A further object of this invention is to provide an improved sugar cane milling system in which the strainer is kept in the center line of the mill tandem and above the mill module so that, in case of any problem in the cush-cush juice extracting conveyor, the cush-cush coming out continuously from the strainer can be fed directly to the mill module without stopping the mill operation. This is accomplished by a bypassing arrangement made for the conveyor. Hence, there is no bottle neck in the crushing mill of this invention. A further object of this invention is to provide an improved sugar cane milling system in which high purity juice recirculation through the mill is reduced and imbibition liquid at higher temperatures is permitted giving extra sugar recovery.

A further object of this invention is to achieve high caloric value of the fuel in the form of discharged bagasse with reduced moisture contents.

A further object of this invention is to provide an improved sugar cane milling system which operates continuously for a long time and does not require highly skilled personnel for maintenance. The present invention gives a very low running and maintenance cost.

Accordingly this invention provides a sugar cane milling system with at least one toothed feeder roller with juice drainage means, singularly provided in addition to and adjacent to one or more two/three roll mill modules in tandem, for feeding a compact mat of prepared cane/bagasse directly to the nip of crushing rolls of the module, without needing a closed stationary pressure chute. This is carried out at almost at the same speed as the surface speed of mill rolls/feed taking rolls, without sharp changes in direction and separating out the superficial juice.

BRIEF DESCRIPTION OF THE DRAWINGS

The foregoing and additional advantages and the inventive features of the present invention will become clearly apparent upon a reading of the ensuing detailed description together with the included drawings wherein:

FIG. 1 is a schematic end view of improved sugar cane milling system according to an embodiment of the present invention, showing one additional toothed feeder roller with a scrapper.

FIG. 2 is a schematic end view of the improved sugar cane milling system, according to another embodiment of the present invention, showing one additional toothed and perforated feeder roller with scraper.

FIG. 3 is a perspective view of the toothed and perforated roller used in the system shown in FIG. 2.

FIG. 10 is a schematic plan view of pressurized cush-cush juice extracting conveyor, used in the improved sugar cane milling system according to present invention.

FIG. 11 is a sectional and view along line 11—11 marked in FIG. 10.

FIG. 12 is a sectional end view along line 12—12 marked in FIG. 10.

FIG. 13 is a schematic view indicating the juice extraction in the cone/taper portion of the conveyor shown in FIG. 10.

FIG. 14 is a schematic plan view of the pressurized cush-cush juice extracting conveyor,according to another embodiment of the present invention.

In all the above figures, the supporting/mounting and driving arrangements of the main mill rolls, as well as additional feeder rollers, are not shown for the sake of simplicity and clarity of the inventive features of the present invention.

DETAILED DESCRIPTION OF THE ILLUSTRATED EMBODIMENTS

Referring to FIGS. 1 to 9 the improved sugar cane milling system of present invention comprises two or three roll mill modules provided in tandem. The two roll mill comprises a top roll 1 and a bottom (discharge) roll 3. The three roll mill comprises a top roll 1, a feed roll 2 and a discharge roll 3. These rolls are made of cast iron or cast steel and are provided with peripheral grooves. Sometimes one or two of these rolls may be lotus rolls, i.e. the rolls having radial holes provided at the periphery and connected to axial holes. The top roll is applied with hydraulic pressure for maintaining compression for juice extraction. For increasing the cane/bagasse feedability according to the present invention, at least one toothed feeder roller 4, as shown in FIG. 1, is provided in addition to and adjacent to the main cane crushing rolls i.e. the top roll 1 and feed roll 2.

Figure 4:
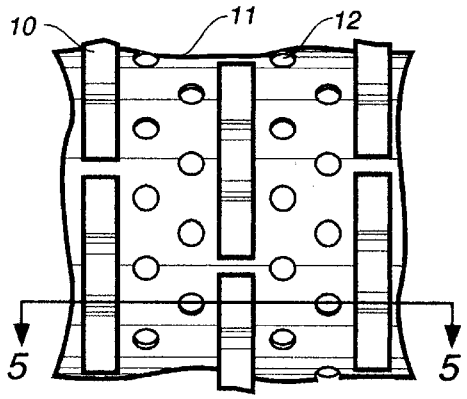
FIG. 4 is a partial elevational view of the toothed and perforated feeder roller, shown in the direction of arrow 2 marked in FIG. 2.
Figure 5:
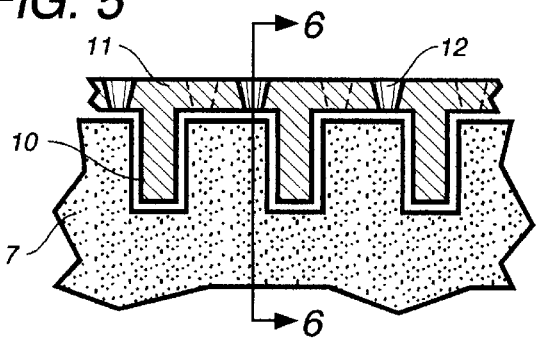
FIG. 5 is a sectional view along line 5—5 marked in FIG. 4, showing the perforated toothed feeder roller with scraper of the system shown in FIG. 2.
Figure 6:
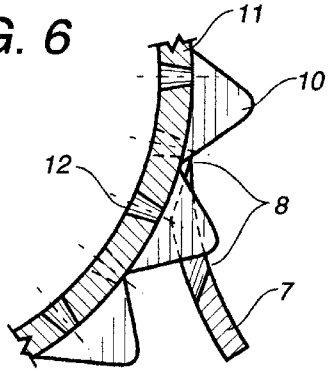
FIG. 6 is a sectional view, along line 6—6 marked in FIG. 5.
Figure 7:
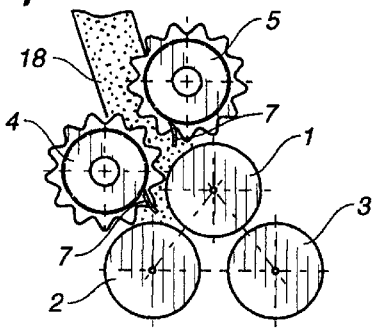
FIG. 7 is a schematic end view of improved sugar cane milling system according to a further embodiment of present invention, showing two additional toothed feeder rollers with scrapers.
Figure 8:
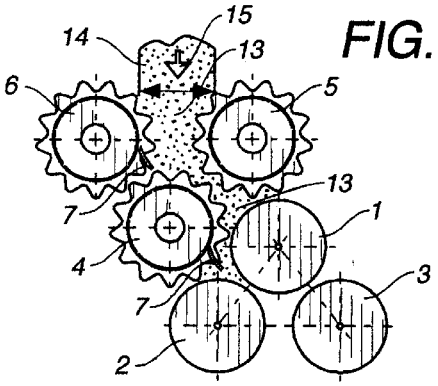
FIG. 8 is a schematic end view of an improved sugar cane milling system, according to a further embodiment of this invention, showing three additional toothed and perforated feeder rollers with scrapers.

In FIG. 7, two additional toothed feeder rollers 4 and 5 are shown and in FIG. 8, three additional toothed feeder rollers 4, 5 and 6 are shown. The additional toothed feeder rollers are adjustably provided with a scraper-cum-short defector 7 to scrape the cane/bagasse mat stuck to the toothed feeder roller surface and to divert it towards the crushing mill module in the compact form. At the same time, the scraper 7 also serves as a juice drainage means and removes the free juice in the prepared cane through the gap 8, between the scraper 7 and the toothed feeder roller 4 (the gap 8 is clearly seen in FIGS. 5 and 6) which comes out before going to mill and thus reduces juice load on the mill as well as reabsorption-absorption of the juice by the cane/bagasse. According to another embodiment of this invention, as shown in FIGS. 3 to 6, the toothed feeder roller 4 can be replaced by a toothed and perforated feeder roller 9. The roller 9 is provided with teeth 10, projecting out of its shell 11. Radial holes, slots or openings 12 are provided in the shell 11 in between the teeth. The teeth 10 may have any contour or shape and are disposed of on the shell 11 in any manner, i.e. in straight rows or a Zig-Zag pattern or a helical or any other staggered manner. The teeth 10 may be hard surfaced for more durability.

The radial holes 12 serve as a juice drainage means and are able to remove free juice in the cane/bagasse while the toothed and perforated feeder roller 9 feeds the cane/bagasse, by compacting it, to the crushing mill module.

The scraper 7 may also be adjustably provided with the toothed and perforated feeder roller 9 to scrape the stuck cane/bagasse mat from the roller surface and to divert it towards the crushing mill module in the compact form and at the same time to remove the free juice, from the cane/bagasse being fed to the mill, through the gap 8 between the scraper 7 and the tip, root and sides of the tooth 10. As a result, the free juice in the cane/bagasse is removed through the radial holes 12 as well as through the gap 8 and is taken out without passing to the crushing mill. This reduces the juice load on the mill as well as juice reabsorption by the cane/bagasse being fed to the mill.

The free juice coming out through holes 12 and gap 8, being superficial juice, is of low brix and low pol which is collected and recirculated over the same mill to absorb more sugar contents from the bagasse by efficiently using the same as maceration/ imbibition liquid. The superficial juice may be passed over a strainer for separating out the cush-cush before recirculating over the mill. The tip face of the scraper 7 is preferably hard faced and lined with stainless steel for better workability. The feeder roller 4 or 9 is preferably driven by the top roll 1 with the help of known transmission means, like a gear train or a chain and sprocket drive (not shown). If required, it can be driven individually in a known manner. In FIGS. 1, 7 and 8 there are provided one, two and three additional toothed feeder rollers in addition to and adjacent to one or more three roll mill modules. Furthermore, toothed feeder rollers may also be provided for further compacting the prepared cane/bagasse to further increase the cane crushing capacity. These feeder rollers may have any combination of toothed feeder roller and perforated toothed feeder roller and with or without a scraper.

Preferably, the scrappers are adjustably provided so as to keep a desired gap between the scraper and the roller shell and also work as a short deflector. The whole arrangement being such that the thickness 13 of the cane/bagasse mat 14 goes on successively reduced along its feed path 1 and the free superficial juice goes on extracting out at each successive stage so as to achieve a much compacted cane mat without superficial juice to be fed into crushing mill module (see FIG. 8). This typical arrangement results in a tremendous increase in milling capacity with increased juice extraction efficiency.

It is clear from FIG. 7 and 8, that the typical arrangements of the additional toothed feeder rollers do not require any closed stationary pressure chute, and very short scrapper-cum-deflectors are used to divert the cane/bagasse directly into the nip of successive feeder rollers/mill rolls.

Figure 9:
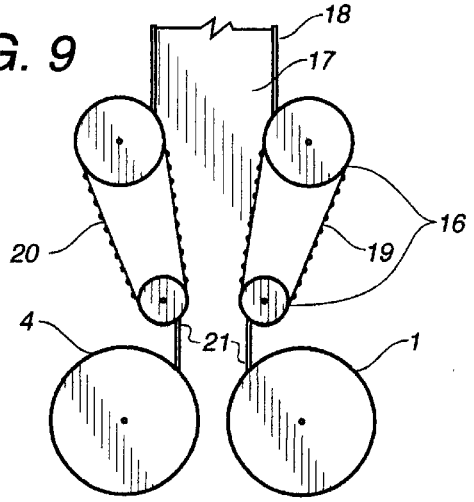
FIG. 9 is a schematic end view of an improved sugar cane milling system according to a further embodiment of the present invention showing one additional toothed feeder roller with a scraper connected to a pilot feeder provided at the exit of the Donnelly chute.

The feeder roller 4 in FIG. 7 and each of the feeder rollers 4 and 5, in FIG. 8 act at two places/zones along the feed path of the cane/bagasse to compact the same twice. As there is a limitation to provide a large number of additional toothed feeder rollers to the mill modules, alternatively, as shown in FIG. 9, a pilot feeder 16 is provided at the exit end 17 of the Donnelly chute 18 which, in turn, feeds the compacted cane/bagasse mat to the additional feeder roller modules of FIGS. 1, 2, 7 or 8. The pilot feeder 16 may be a toothed or ribbed roller (not shown) provided at one side of the exit end of the Donnelly chute or two toothed or ribbed rollers (not shown) provided at two opposite sides of the exit end of the Donnelly chute.

Preferably, the pilot feeder 16 comprises a pair of belt conveyers 19 provided at the exit end 17 of the Donnelly chute 18, and converging towards toothed feeder rollers 4, 5, or 6. The belt surface is provided with projections for gripping the cane/bagasse. Guide plates 21 may also be provided at the lower end of the belt conveyors 19. The belts may be provided with perforations for separating out the superficial juice while compacting the well prepared cane/bagasse.

Juice extracted in various mill modules contains very fine particles of bagasse known as cush-cush. The juice, before being taken to boiling or further processing for making sugar, is strained for separating out the cush-cush by passing over an in line strainer. The cush-cush soaked with juice, along with overflow juice from the strainer, is fed into the mill module under the strainer for milling along with the bagasse. This high purity juice coming with cush-cush and recirculated through the mill creates extra slippage, juice overloading and poor juice drainage resulting in lower milling capacity and juice extraction efficiency. Therefore, it was necessary to separate out this rich juice from the cush-cush for further increasing the milling capacity and juice extraction efficiency with less power consumption of the improved cane crushing system of the present invention.

Now referring to FIGS. 10 to 14, the pressurized cush-cush juice extracting conveyor incorporated in the improved sugar cane milling system of the present invention comprises an open trough 22 having perforations 23 in its bottom. The open sides of the trough 22 are provided with support flanges 24. A screw 25 is provided inside the trough 22 and rotatably supported at two ends 26 and 27. The end 27 is provided with power transmission means, such as gear 28. The perforated trough 22, at its bottom, is encased by a tray 29, having an outlet for draining out the juice. The open trough 22 converges and forms an enclosed frustum of cone 31 towards the drive end 27 of the conveyor. The diameter of the screw 2 is also reduced according to the size of the frustum of cone 31. The cush-cush strained by the strainer (not shown), provided out of the center line of the mill tandem, is fed into the trough 22 of the conveyor as shown by arrow 'C' in FIG. 14. The extra unabsorbed juice in the cush-cush drips out through the perforated trough bottom into the tray 29 when the cush-cush moves along the straight portion of the trough 22. When this cush-cush having absorbed juice only, enters the frustum of the cone/converging portion 31 of the trough 22, it is pressed by the screw 2 against the enclosed trough casing and most of the absorbed juice is also extracted out from the cush-cush which comes out through the perforations provided all around in the frustum of cone portion 31 of the trough and the juice is collected in the tray 29 which is then drained out through the outlet 30. The screw 25 may also have reduced pitch along with reduced diameter in the converging portion 31 of the trough.

The cush-cush with a small amount of residual juice coming out of the cone portion 31 through its outlet 32, is fed to the mill module through the bottom opening 33 provided towards the end 27 (as shown in FIG. 14). As shown in FIG. 10, when the strainer is provided in-line with the center line of the mill tandem, the cush-cush with residual juice, coming out of the cone portion 31, through its outlet 32, is fed to another screw conveyor 34 provided side by side with the first pressurized conveyor, described hereinbefore. The lead of the screw 35 of the second conveyor 34 is kept in an opposite direction to the lead of screw 25 and is rotated in the same direction with the help of pinion 36 and gear 37. The second conveyor 34 brings back the cush-cush discharged from the first conveyor and feeds it in the mill module through the bottom opening 33 towards the end 26. The second conveyer 34 has an open casing/trough 38 with support flanges 39 and without any perforations in its trough 38.

The rich juice extracted out of the cush-cush, according to the present invention described above, is collected from the outlet 30 of the tray 29 and is taken out without recirculation through the mill module. The main advantages of this are high purity juice re-circulation through the mill is avoided which reduces juice loading and slippage of mill module rolls.

It is clear from the above description that, according to the present invention, even a single toothed feeder roller with or without perforations and/or with or without scraper, provided in addition to and adjacent to one or more two or three roll mill modules in tandem, feeds the prepared cane/bagasse in compact form, without using a closed stationary pressure chute, almost at the same speed as of mill rolls and without sharp changes in direction. The free superficial juice from the cane/bagasse is also removed when the toothed feeder roller is used with a scraper or when the toothed feeder roller is also provided with radial holes.

The main advantages achieved by this invention are as follows:

I) The bulk density of cane/bagasse being fed to the mill is increased due to the positive grip of toothed feeder roller on cane/bagasse mat. This gives a significant increase in crushing rate with a simple construction.

II) Feed to discharge operating opening ratio is reduced resulting in more juice extraction at the feed rolls and reduction in moisture percentage of the discharged bagasse which is used as fuel and thus achieves a high calorie value of fuel.

III) A higher rate of imbibition liquid, at higher temperature, to achieve extra sugar recovery from the bagasse, due to slip-free high grip over the bagasse mat.

IV) Lesser slippage allows reduction in mill speed thereby giving improved juice drainage and reduction in reabsorption of juice, further resulting in reduction of frictional losses and power consumption.

V) Fluent lifting of the top roll against hydraulic pressure due to reduction of feed to discharge operating opening ratio, brings the feed and discharge roll's resultant reaction near to vertical.

VI) Less wear and tear of various parts and hence low maintenance cost without needing very skilled personnel and low breakdown rates. This problem troubled some closed stationary pressure chute, used with a pair of toothed feeder rollers in poor art, has been dispensed with. The present invention gives trouble free continuous running for a longer time and gives high average output. It is therefore apparent that the present invention accomplishes the intended objects. The above description with reference to drawings is given just to understand the invention rather than to limit its scope.

What I claim is:

1. A sugar cane or bagasse feeding system for a sugar cane crushing mill module comprising at least one toothed feeder roller means with juice drainage means, said feeder roller means being singularly provided in addition to and adjacent to at least one tandem mill module having at least two crushing rolls, said feeder roller means for feeding a compact mat cane/bagasse directly to a nip of the crushing rolls of said module at approximately a same speed as a surface speed of the crushing rolls without a sharp change in direction, said juice drainage means for separating out superficial juice from said mat as said mat passes to the crushing rolls, said feeder roller means having a plurality of individual teeth projecting out of an outer surface of a roller shell in a desired pattern, said juice drainage means comprising radial holes provided in the roller shell in between the plurality of individual teeth.

2. A system according to claim 1 wherein the said juice drainage means further comprises a scraper-cum-short deflector provided against the feeder roller means at a desired gap.

3. A system according to claim 1 wherein a scraper-cum-short deflector is positioned against said feeder roller means.

4. A system according to claim 1, said feeder roller means comprises two toothed feeder rollers each with juice drainage means, said feeder rollers being adjacent to the mill module for successively compacting the cane/bagasse mat being fed to the mill module.

5. A system according to claim 1, said feeder roller means comprising three toothed feeder rollers with juice drainage means positioned adjacent to the mill module for successively compacting the cane/bagasse mat being fed to the mill module along with separating out the superficial juice.

6. A sugar cane or bagasse feeding system for a sugar cane crushing mill module comprising at least one toothed feeder roller means with juice drainage means, said feeder roller means being singularly provided in addition to and adjacent to at least one tandem mill module having at least two crushing rolls, said feeder roller means for feeding a compact mat cane/bagasse directly to a nip of the crushing rolls of said module at approximately a same speed as a surface speed of the crushing rolls without a sharp change in direction, said juice drainage means for separating out superficial juice from said mat as said mat passes to the crushing rolls, said feeder roller means having a plurality of individual teeth projecting out of an outer surface of a roller shell in a desired pattern, wherein a Donnelly chute having an exit end is positioned adjacent the feeder roller means for feeding cane/bagasse to the feeder roller means and further including a pilot feeder means positioned in between said feeder roller means and said exit end of said Donnelly chute, said pilot feeder means for feeding the cane/bagasse in compacted form to said feeder roller means.

7. A system according to claim 6 wherein said pilot feeder means comprises a pair of belt conveyers provided at the exit end of the Donnelly chute, said pair of belts converging towards the feeder roller means.

8. A system according to claim 7 wherein said pair of belts have perforations for separating out the superficial juice while compacting the cane/bagasse.

* * * * *